US005477212A

United States Patent [19]

Rumpel

[11] Patent Number: 5,477,212

[45] Date of Patent: Dec. 19, 1995

[54] SURVEILLANCE CAMERA SIMULATOR APPARATUS

[76] Inventor: David C. Rumpel, 100 Smith Ave., Lot 13, New Ellenton, S.C. 29809

[21] Appl. No.: 276,311

[22] Filed: Jul. 18, 1994

[51] Int. Cl.[6] ..... G08B 13/19

[52] U.S. Cl. ..... 340/691; 340/541; 340/567; 340/693; 348/121

[58] Field of Search ..... 340/691, 693, 340/541, 567; 348/155, 152, 121

[56] References Cited

U.S. PATENT DOCUMENTS

| | | | |
|---|---|---|---|
| 4,347,590 | 8/1982 | Heger et al. | 340/691 |
| 4,651,144 | 3/1987 | Pagano | 340/693 |
| 4,845,464 | 7/1989 | Deori et al. | 340/429 |
| 4,970,494 | 11/1990 | Keely et al. | 340/567 |
| 5,015,994 | 5/1991 | Hoberman et al. | 340/567 |
| 5,027,105 | 6/1991 | Dailey et al. | 340/571 |

*Primary Examiner*—Glen Swann

[57] ABSTRACT

A housing having a plurality of housing cavities therewithin is arranged to effect the flashing of LED bulbs and the emission of an audible tone to effect simulation of a surveillance camera. The apparatus is arranged for ease of mounting, as well as ease of simulation of such camera structure. Additionally, actuation of the LED bulbs and the emission of the audible warning tone is provided by sensing of movement within an area or space by a motion detector sensor.

10 Claims, 4 Drawing Sheets

SURVEILLANCE CAMERA SIMULATOR APPARATUS

BACKGROUND OF THE INVENTION

1. Field of the Invention

The field of invention relates to surveillance camera structure, and more particularly pertains to a new surveillance camera simulator apparatus wherein the same is arranged to provide for a housing organization to simulate a surveillance camera structure.

2. Description of the Prior Art

Surveillance cameras are known in the prior art and typically operate to convert light signals into electrical signals suitable for display on a television monitor. In addition, surveillance cameras can also serve as a visual deterrent to criminal activities when positioned in a conspicuous location.

The instant invention attempts to overcome deficiencies of the prior art by providing for a camera to only simulate surveillance within a area or space and the like for ease of actuation and mounting of the structure, as well as available at minimal cost to consumers and the like and to this end, the present invention substantially fulfills this need.

SUMMARY OF THE INVENTION

In view of the disadvantages inherent in the known types of surveillance camera apparatus now present in the prior art, the present invention provides a surveillance camera simulator apparatus wherein the same is arranged to simulate a surveillance camera to discourage criminal activity. As such, the general purpose of the present invention, which will be described subsequently in greater detail, is to provide a new surveillance camera simulator apparatus and method which has many of the advantages of the prior art listed heretofore and many novel features that result in an surveillance camera simulator apparatus which is not anticipated, rendered obvious, suggested, or even implied by any of the prior art, either alone or in any combination thereof.

To attain this, the present invention provides a housing having a plurality of housing cavities therewithin is arranged to effect the flashing of LED bulbs and the emission of an audible tone to effect simulation of a surveillance camera. The apparatus is arranged for ease of mounting, as well as ease of simulation of such camera structure. Additionally, actuation of the LED bulbs and the emission of the audible warning tone is provided upon sensing of movement within an area or space by a motion detector sensor.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any It is therefore an object of the present invention to provide a new surveillance camera simulator apparatus and method which has many of the advantages of the prior art listed heretofore and many novel features that result in a surveillance camera simulator apparatus which is not anticipated, rendered obvious, suggested, or even implied by any of the prior art, either alone or in any combination thereof.

It is another object of the present invention to provide a new surveillance camera simulator apparatus which may be easily and efficiently manufactured and marketed.

It is a further object of the present invention to provide a new surveillance camera simulator apparatus which is of a durable and reliable construction.

An even further object of the present invention is to provide a new surveillance camera simulator apparatus which is susceptible of a low cost of manufacture with regard to both materials and labor, and which accordingly is then susceptible of low prices of sale to the consuming public, thereby making such surveillance camera simulator apparatus economically available to the buying public.

Still yet another object of the present invention is to provide a new surveillance camera simulator apparatus which provides in the apparatuses and methods of the prior art some of the advantages thereof, while simultaneously overcoming some of the disadvantages normally associated therewith.

Still an even further object of the present invention is to provide a new surveillance camera simulator apparatus operable to flash LED bulbs and emit an audible warning tone to effect simulation of a surveillance camera.

Yet an even further object of the present invention is to provide a new surveillance camera simulator apparatus which is operative by flashing LED bulbs and emitting an audible tone to simulate a surveillance camera actuation of the LED bulbs upon sensing of movement within an area or space by a motion detector sensor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
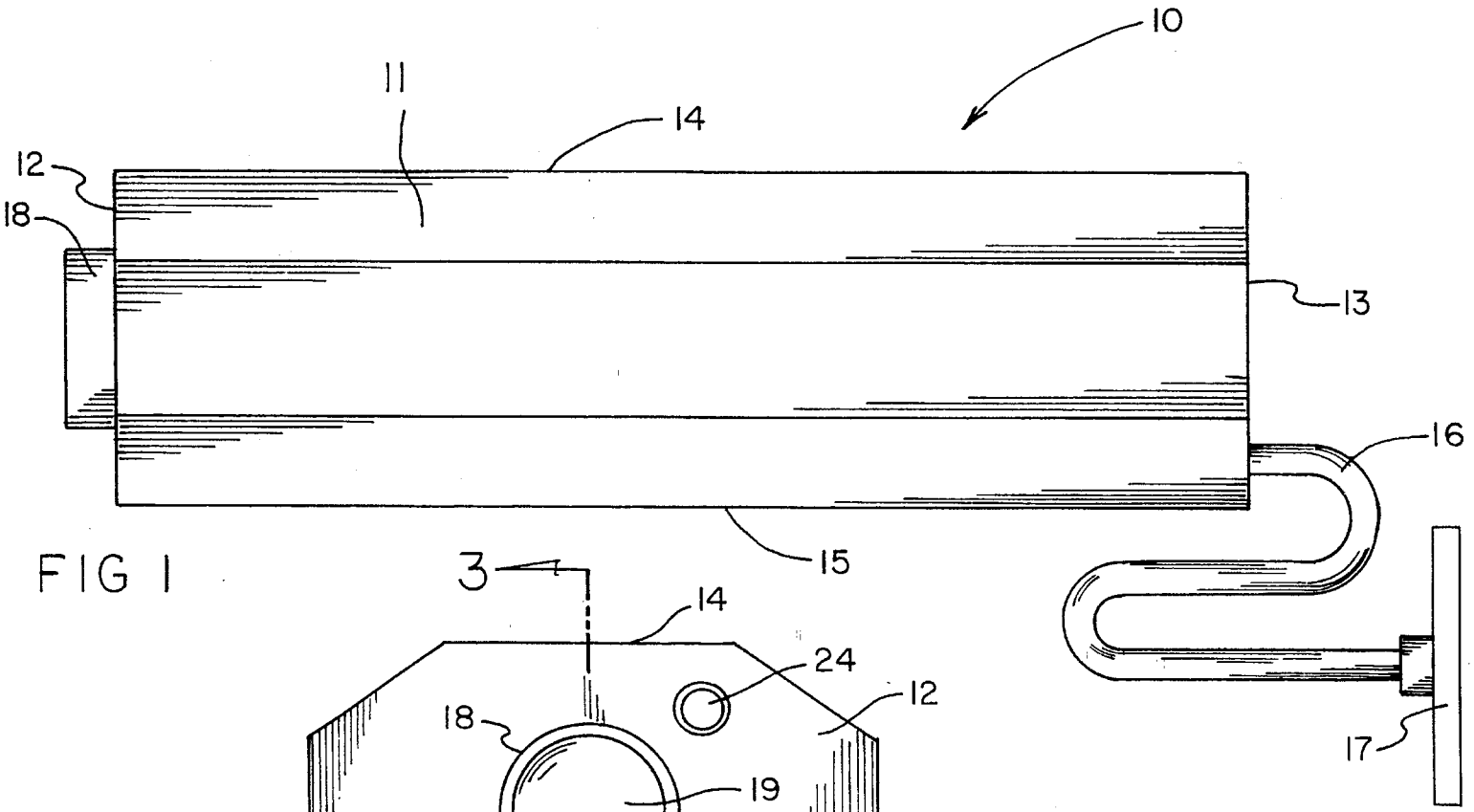
FIG. 1 is an orthographic side view of the invention.
Figure 2:
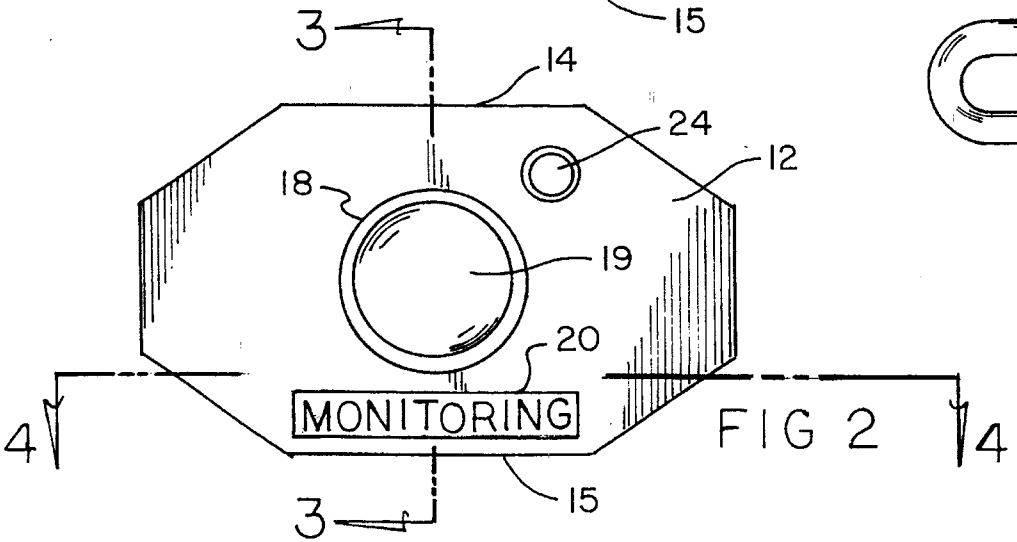
FIG. 2 is an orthographic front view of the invention.

With reference now to the drawings, a new surveillance camera simulator apparatus embodying the principles and concepts of the present invention and generally designated by the reference numerals 10 will now be described.

More specifically, the surveillance camera simulator apparatus 10 of the instant invention comprises a housing 11 having a front wall 12 spaced from a rear wall 13, a top wall 14 spaced from a bottom wall 15, wherein a simulates cable 16 extends from the rear wall and is secured to a cable mounting bracket 17 having a simulated cable mounting bracket socket, with at least one fastener directed through the cable mounting bracket for securement of the cable mounting bracket to a wall surface. The cable mounting bracket 17 is arranged to receive a free distal end of the cable 16 therewithin to simulate a video transmission cable as is provided for use by an operable surveillance camera. If so desired, a standard RG-6 TV cable connection plug and cable end may be employed.

Figure 3:
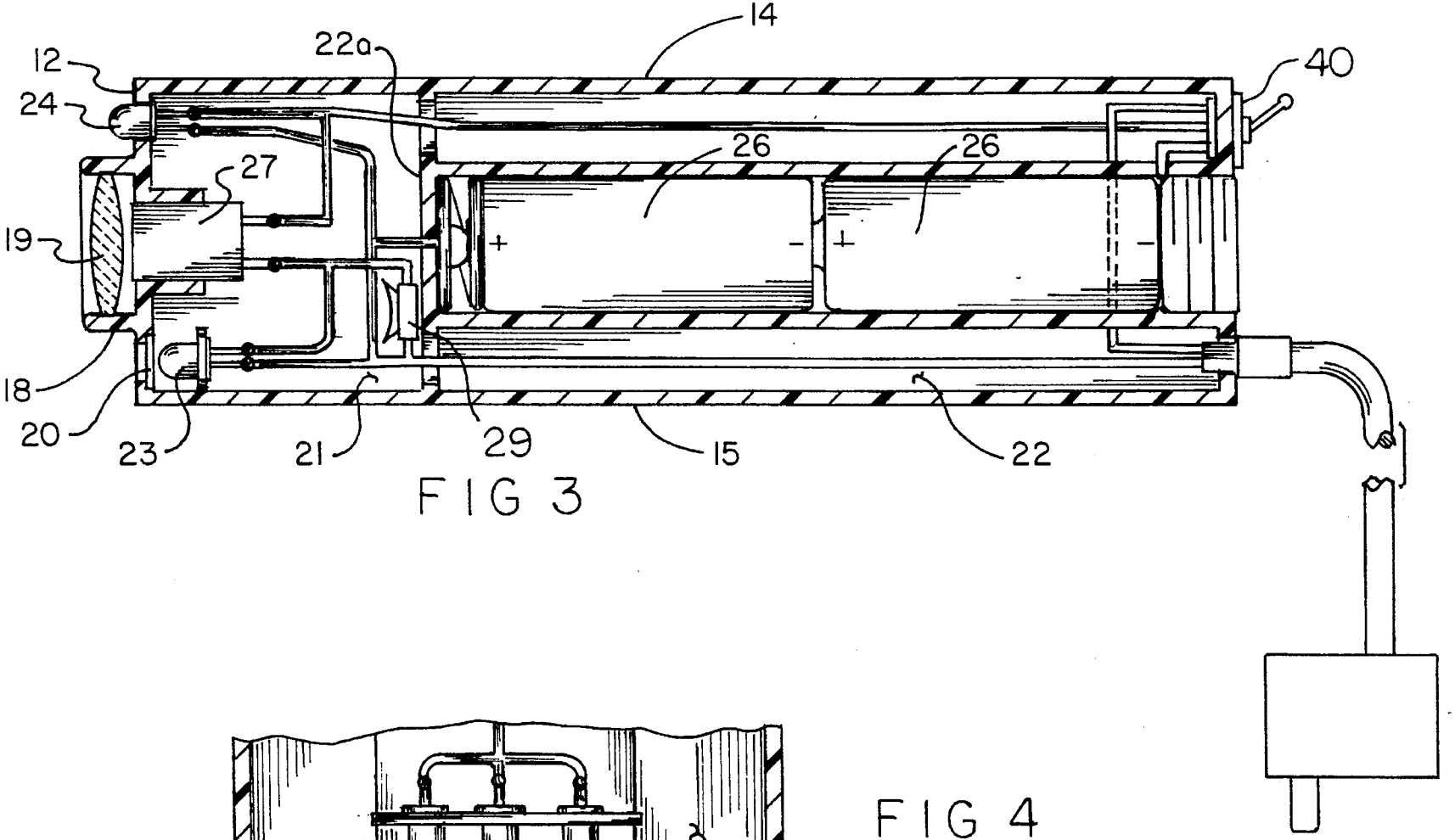
FIG. 3 is a cross sectional view, taken along the lines 3—3 of FIG. 2 in the direction indicated by the arrows.
Figure 4:
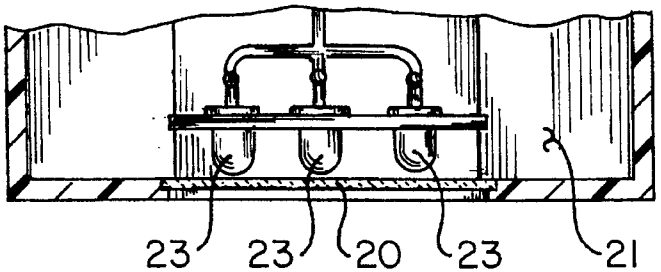
FIG. 4 is a further cross sectional view, taken along the lines 4—4 of FIG. 2 in the direction indicated by the arrows.

As best illustrated in FIG. 3 of the drawings, the front wall 12 of the device 10 is arranged to include a lens housing 18 having a first lens 19 mounted therewithin in communication with a first cavity 21 within the housing separated from a second cavity 22 by a partition wall 22*a*. A second transparent lens 20 is mounted between the bottom wall 15 and the lens housing 18 and projects through the front wall 12. Positioned in adjacency to the second transparent lens 20 is a signal emitting means comprising a row of first illumination bulb members 23 of flashing LED construction for sequential flashing to simulate monitoring in use of the device 10. Further, the signal emitting means also includes a piezoelectric beeping noisemaker 29 wired together with the LEDs 23 so as to operate therewith.

Figure 5:
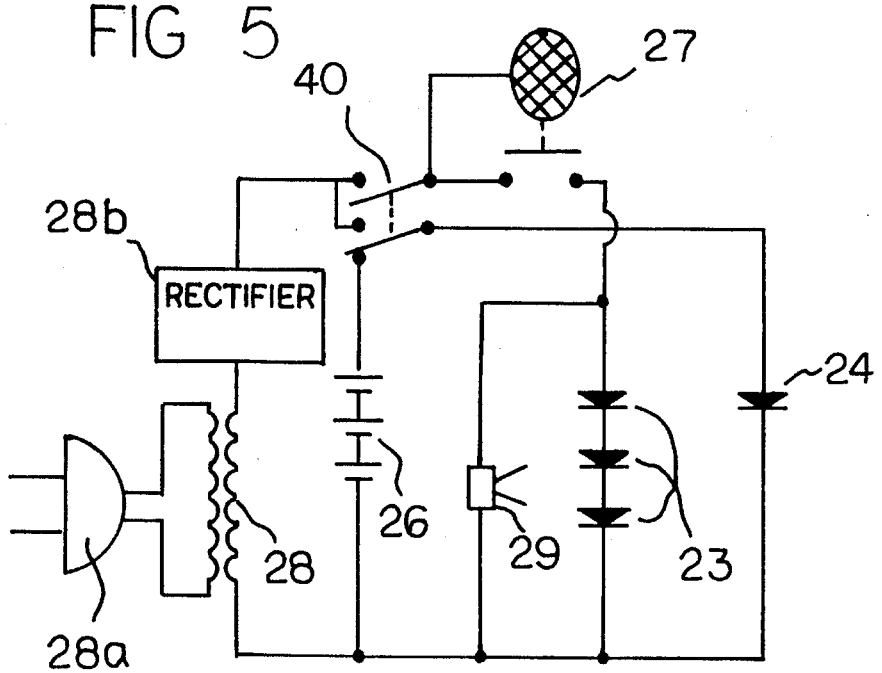
FIG. 5 is a schematic electrical diagram of the invention.

As illustrated in FIG. 5, a transformer 28 having a rectifier 28*b* cooperates between an external electric power supply through a plug 28*a* to provide power to the device 10 through a ganged switch 40 and motion detector 27. To effect electrical communication of the first illumination bulb members 23 and the piezoelectric beeping noisemaker 29 with the transformer, a motion detector switch 27 is mounted through the front wall 12 between the partition wall 22*a* and the first lens 19. To this end, detection of movement by the motion detection switch 27 effects the flashing of the LED bulb members 23 and provides an audible warning via piezoelectric beeping noisemaker 29 arranged to indicate actuation of the device in a simulation of a surveillance camera structure. Further, the device 10 includes a second continuously flashing LED illumination bulb 24 which may be selectively positioned in electrical communication with either the batteries 26, or the transformer 28 through an operation of the ganged switch 40. Regardless of the positioning of the ganged switch, the second flashing LED is operable to continuously flash, even in an absence of external A/C power. Thus, switch 40 permits selective use of either the second flashing LED 24 alone (powered by the batteries 26), or a combination of the continuously flashing second LED 24 and the motion detector responsive LEDs 23 and noisemaker 29 (all powered by the transformer 28 through external A/C power).

Figure 6:
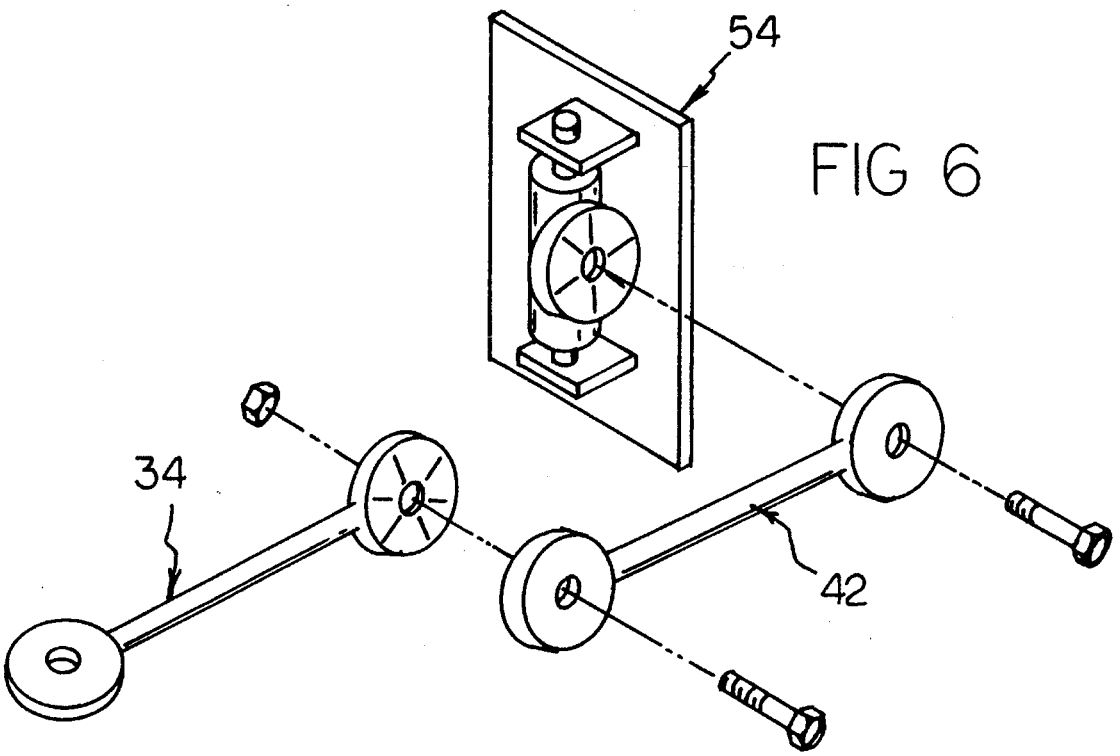
FIG. 6 is an isometric illustration of the mounting structure for the housing of the invention.
Figure 7:
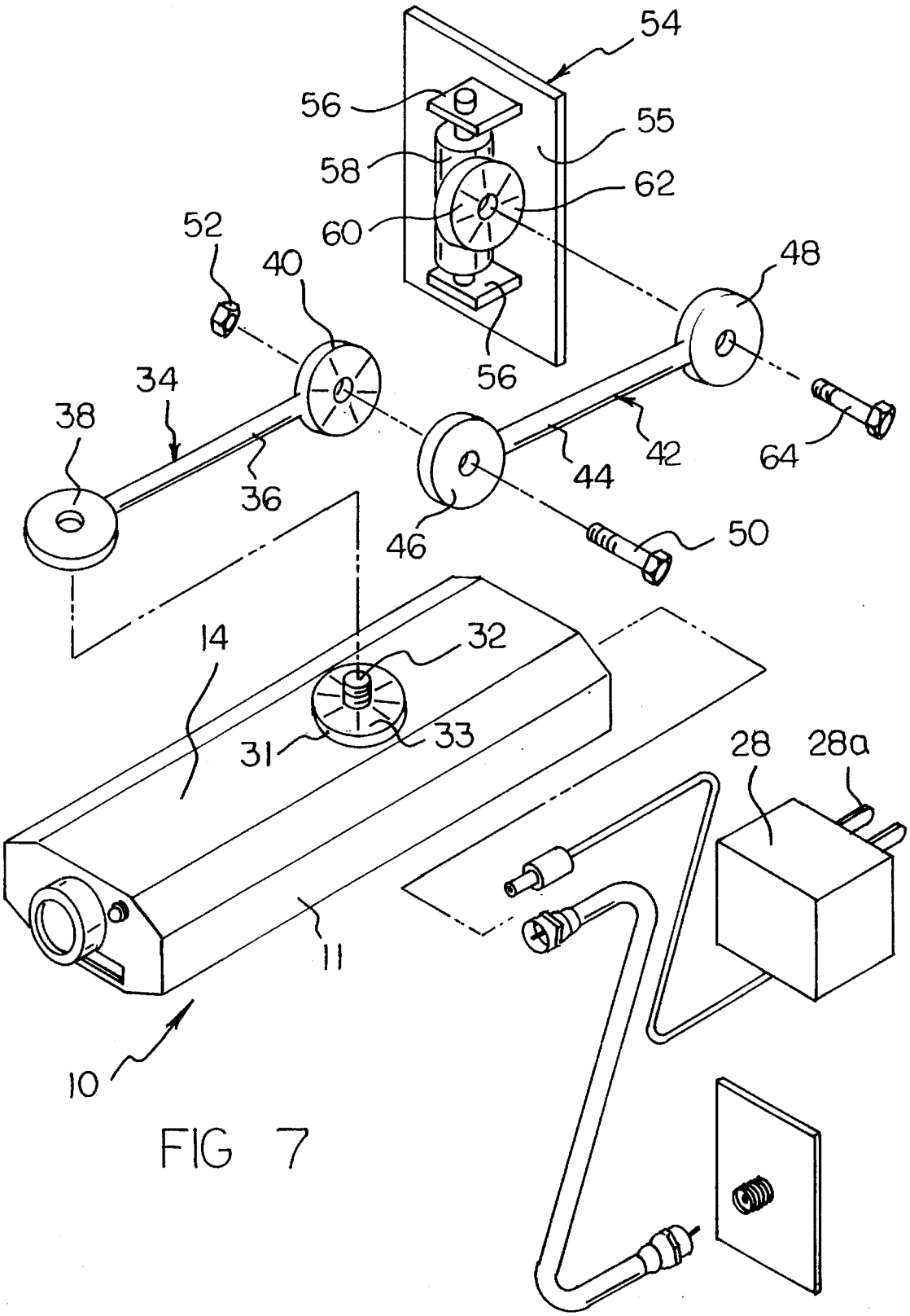
FIG. 7 is an exploded isometric illustration of the invention.

FIGS. 6 and 7 illustrate mounting structure means in which the top wall 14 of the housing 11 is arranged to receive and have fixedly secured thereto a male mounting plate 31, having a threaded projection 32 extending upwardly therefrom and radially extending ridges 33 positioned therearound. A first mounting arm 34 includes a first center bar 36 having opposed first and second ends, with a first mounting arm first disc 38 mounted to said first end of the first center bar, and a first mounting arm second disc 40 mounted to the second end of the first center bar. The first mounting arm first disc 38 and the first mounting arm second disc 40 are positioned so as to lie within orthogonally oriented planes, with each of the discs having ridges on a side thereof. Thus, the first mounting arm first disc 38 can be positioned in abutting contact with the male mounting plate 31 such that the threaded projection extends through an aperture in the first mounting arm first disc, whereby a suitable threaded fastener can be coupled to the threaded projection to selectively couple the first mounting arm 34 to the camera housing 11 in a desired orientation.

Continuing, the mounting structure means further comprises a second mounting arm 42 including a second center bar 44 having opposed first and second ends, with a second mounting arm first disc 46 mounted to said first end of the second center bar, and a second mounting arm second disc 48 mounted to the second end of the second center bar. The second mounting arm first disc 46 and the second mounting arm second disc 48 are positioned so as to lie within parallely oriented planes, with each of the discs having ridges on a side thereof. Thus, the second mounting arm first disc 46 is positioned in abutting contact with the first mounting arm second disc 40 such that a threaded bolt 50 extends through apertures in both the second mounting arm first disc and the first mounting arm second disc, whereby a nut 52 can be coupled to the bolt 50 to selectively couple the second mounting arm 42 to the first mounting arm 34 at a desired orientation.

Further, the mounting structure means comprises a pivotal mounting plate assembly 54 including a mounting plate 55 securable to a wall surface and having a pair of spaced, projecting plates 56 which pivotally mount a center axle 58 therebetween. The center axle 58 supports a mounting boss 60 having radially extending ridges 62 extending therearound arranged to mate with the second arm second disc 48 and be coupled thereto by a further threaded bolt 64 at a desired orientation. Thus, the mounting structure means permits the camera 10 to be selectively positioned in a desired orientation.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A surveillance camera simulator apparatus, comprising:

a housing, the housing having a front wall, a rear wall spaced from the front wall, a side wall, a top wall, and a bottom wall;

a cable extending from the housing, with the cable having a cable first end secured to the housing, and a cable second end spaced from the housing;

a cable mounting bracket, the cable mounting bracket including a cable mounting bracket socket, with the cable mounting bracket socket including a fastener directed therethrough for securement of the cable mounting bracket to a support surface; and, signal emitting means mounted within the housing and extending through the housing front wall for radiating a visual signal from said apparatus;

wherein the signal emitting means includes a lens housing extending through the front wall, and a first lens mounted within the lens housing, the housing having a first cavity and a second cavity, and a partition wall separating said first cavity and said second cavity, with a motion detector switch mounted within the first cavity in adjacency to the first lens, and at least one battery member mounted within the second cavity in electrical communication with said motion detector switch, and a second transparent lens directed through the front wall between the lens housing and the bottom wall, with at least one second illumination bulb mounted within the first cavity in adjacency to the second lens, with the first illumination bulb and the second illumination bulb being in electrical communication with the at least one battery through the motion detector switch.

2. An apparatus as set forth in claim 1, wherein the first and second illumination bulbs each comprises a flashing LED.

3. An apparatus as set forth in claim 2, and further comprising a piezo-electric beeping noisemaker in electrical communication with said at least one battery.

4. An apparatus as set forth in claim 3, and further comprising a mounting structure means for selectively mounting said surveillance camera simulator apparatus to a vertical surface at a desired orientation.

5. A surveillance camera simulator apparatus, comprising:

a camera housing, the housing having a front wall, a rear wall spaced from the front wall, a side wall, a top wall, and a bottom wall;

signal emitting means mounted within the housing and extending through the housing front wall for radiating a visual signal from said apparatus; and, mounting structure means for selectively mounting said surveillance camera simulator apparatus to a vertical surface at a desired orientation;

wherein the mounting structure means comprises a mounting plate secured to said top wall, the mounting plate including a mounting plate socket, a mounting sphere rotatably received within said mounting plate socket, a rod fixedly secured to said mounting sphere projecting from said mounting sphere, and a support plate secured fixedly to said rod spaced from said mounting sphere.

6. A surveillance camera simulator apparatus, consisting of:

a camera housing, the housing having a front wall, a rear wall spaced from the front wall, a side wall, a top wall, and a bottom wall;

a mounting plate secured to said top wall, the mounting plate including a mounting plate socket, a mounting sphere rotatably received within said mounting plate socket, a rod fixedly secured to said mounting sphere projecting from said mounting sphere, and a support plate secured fixedly to said rod spaced from said mounting sphere;

and, signal emitting means mounted within the housing and extending through the housing front wall for radiating a visual signal from said apparatus.

7. A surveillance camera simulator apparatus comprising:

a housing, the housing having a front wall, a rear wall spaced from the front wall, a side wall, a top wall, and a bottom wall;

a cable extending from the housing, with the cable having a cable first end secured to the housing, and a cable second end spaced from the housing;

a cable mounting bracket, the cable mounting bracket including a cable mounting bracket socket, with the cable mounting bracket socket including a fastener directed therethrough for securement of the cable mounting bracket to a support surface;

a mounting plate secured to said top wall, the mounting plate including a mounting plate socket, a mounting sphere rotatably received within said mounting plate socket, a rod fixedly secured to said mounting sphere projecting from said mounting sphere, and a support plate secured fixedly to said rod spaced from said mounting sphere; and, signal emitting means mounted within the housing and extending through the housing front wall for radiating both a visual signal and an audible signal from said apparatus.

8. An apparatus as set forth in claim 7, wherein the signal emitting means includes a lens housing extending through the front wall, and a first lens mounted within the lens housing, the housing having a first cavity and a second cavity, and a partition wall separating said first cavity and said second cavity, with a motion detector switch mounted within the first cavity in adjacency to the first lens, and at least one battery member mounted within the second cavity in electrical communication with said motion detector switch, and a second transparent lens directed through the front wall between the lens housing and the bottom wall, with at least one second illumination bulb mounted within the first cavity in adjacency to the second lens, with the first illumination bulb and the second illumination bulb being in electrical communication with the at least one battery through the motion detector switch.

9. An apparatus as set forth in claim 8, wherein the signal emitting means further includes a piezo-electric beeping noisemaker in selective electrical communication with said at least one battery.

10. An apparatus as set forth in claim 9, and further comprising a plug engagable to an electrical outlet; a transformer electrically connected to the plug; a rectifier electrically connected to the transformer for converting A/C power to direct current power, and a switch for selectively and exclusively communicating either one of the rectifier and the at least one battery to the LEDs.

* * * * *